US006961439B2

(12) United States Patent
Ballas

(10) Patent No.: US 6,961,439 B2
(45) Date of Patent: Nov. 1, 2005

(54) METHOD AND APPARATUS FOR PRODUCING SPATIALIZED AUDIO SIGNALS

(75) Inventor: James A. Ballas, Arlington, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 829 days.

(21) Appl. No.: 09/962,158

(22) Filed: Sep. 26, 2001

(65) Prior Publication Data

US 2003/0059070 A1 Mar. 27, 2003

(51) Int. Cl.[7] ..... H04R 5/02
(52) U.S. Cl. ..... 381/309; 381/310; 381/17
(58) Field of Search ..... 381/309, 310, 381/17, 18, 1, 26, 74

(56) References Cited

U.S. PATENT DOCUMENTS 3,962,543 A * 6/1976 Blauert et al. ..... 381/310
5,146,501 A * 9/1992 Spector ..... 381/309
5,272,757 A 12/1993 Scofield et al.
5,438,623 A 8/1995 Begault
5,459,790 A 10/1995 Scofield et al.
5,633,993 A * 5/1997 Redmann et al. ..... 345/419
5,661,812 A 8/1997 Scofield et al.
5,680,465 A 10/1997 Boyden
5,815,579 A 9/1998 Boyden
5,841,879 A 11/1998 Scofield et al.
5,943,427 A 8/1999 Massie et al.
5,953,434 A 9/1999 Boyden
6,021,206 A * 2/2000 McGrath ..... 381/310
6,038,330 A 3/2000 Meucci, Jr.
6,144,747 A * 11/2000 Scofield et al. ..... 381/309
6,259,795 B1 7/2001 McGrath
6,370,256 B1 * 4/2002 McGrath ..... 381/310

OTHER PUBLICATIONS

Chong-Jin Tan et al., Direct Concha Excitation for the Introduction of Individualized Hearing Cues, Journal of Audio Engineering Society, Vo. 48, No. 7/8; Jul.-Aug., 2000.

* cited by examiner

*Primary Examiner*—Xu Mei
(74) *Attorney, Agent, or Firm*—John J. Karasek; Thomas D. Robbins

(57) ABSTRACT

A method and apparatus for producing virtual sound sources that are externally perceived and positioned at any orientation in azimuth and elevation from a listener is described. In this system, a set of speakers is mounted in a location near the temple of a listener's head, such for example, on an eyeglass frame or inside a helmet, rather than in earphones. A head tracking system determines the location and orientation of the listener's head and provides the measurements to a computer which processes audio signals, from a audio source, in conjunction with a head related transfer function (HRTF) filter to produce spatialized audio. The HRTF filter maintains the virtual location of the audio signals/sound, thus allowing the listener to change locations and head orientation without degradation of the audio signal. The audio system of the present invention produces virtual sound sources that are externally perceived and positioned at any desired orientation in azimuth and elevation from the listener.

9 Claims, 3 Drawing Sheets

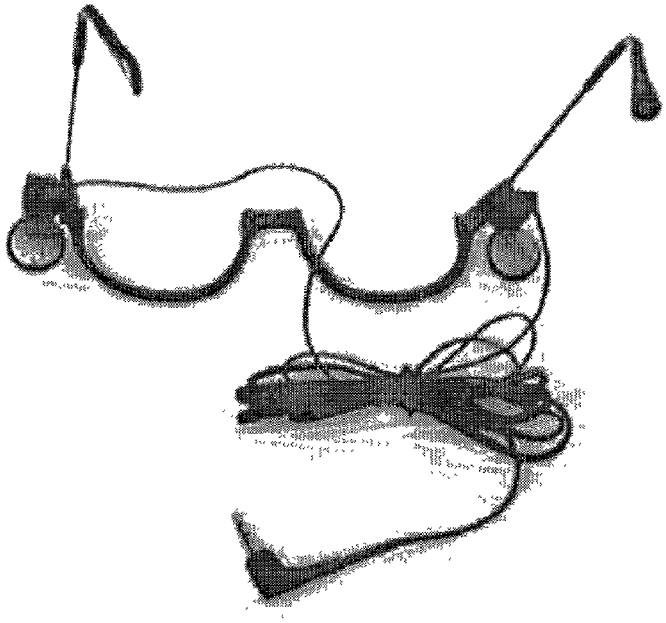
Figure 3. Eyeglass frame mount prototype
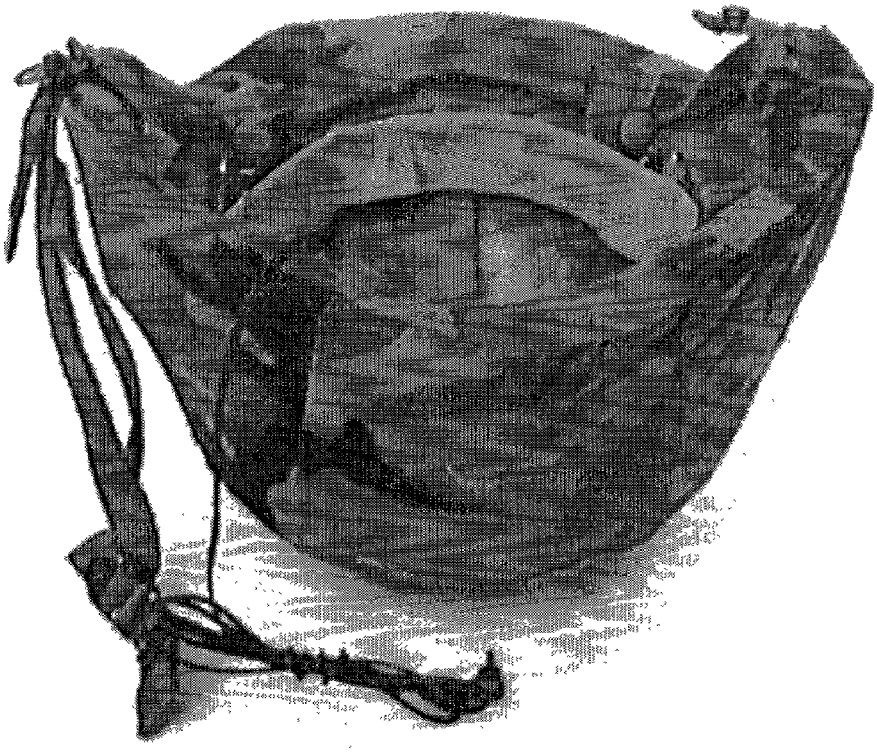
Figure 4. Helmet mount prototype

METHOD AND APPARATUS FOR PRODUCING SPATIALIZED AUDIO SIGNALS

FIELD OF THE INVENTION

This invention relates to audio systems. More particularly, it relates to a system and method for producing spatialized audio signals that are externally perceived and positioned at any orientation and elevation from a listener.

BACKGROUND AND SUMMARY OF THE INVENTION

Spatialized audio is sound that is processed to give the listener an impression of a sound source within a three-dimensional environment. A more realistic experience is observed when listening to spatialized sound than stereo because stereo only varies across one axis, usually the x (horizontal) axis.

In the past, binaural sound from headphones was the most common approach to spatialization. The use of headphones takes advantage of the lack of crosstalk and a fixed position between sound source (the speaker driver) and the ear. Gradually, these factors are endowed upon conventional loudspeakers through more sophisticated digital signal processing. The wave of multimedia computer content and equipment has increased the use of stereo speakers in conjunction with microcomputers. Additionally, complex audio signal processing equipment, and the current consumer excitement surrounding the computer market, increases the awareness and desire for quality audio content. Two speakers, one on either side of a personal computer, carry the particular advantage of having the listener sitting rather closely and in an equidistant position between the speakers. The listener is probably also sitting down, therefore moving infrequently. This typical multimedia configuration probably comes as close to binaural sound using headphones as can be expected from free field speakers, increasing the probability of success for future spatialization systems.

Spatial audio can be useful whenever a listener is presented with multiple auditory streams. Spatial audio requires information about the positions of all events that need to be audible, including those outside of the field of vision, or that would benefit from increased immersion in an environment. Possible applications of spatial audio processing techniques include:

- Military communication systems to and between individuals within military vehicles, ships and aircraft as well as to and between dismounted soldiers;
- complex supervisory control systems such as telecommunications and air traffic control systems;
- complex supervisory control system such as telecommunications and air traffic control systems;
- civil and military aircraft warning systems;
- teleconferencing and telepresence applications;
- virtual and augmented reality environments;
- computer-user interfaces and auditory displays, especially those intended for use by the visually impaired;
- personal information and guidance systems such as those used to provide exhibit information to visitors in a museum;
- arts and entertainment, especially video games and music, to name but a few.

Environmental cues, such as early echoes and dense reverberation, are important for a realistic listening experience and are known to improve localization and externalization of audio sources. However, the cost of exact environmental modeling is extraordinarily high. Moreover, existing spatial audio systems are designed for use via headphones. This requirement may result in certain limitations on their use. For example, spatial audio may be limited to those applications for which a user is already wearing some sort of headgear, or for which the advantages of spatial sound outweigh the inconvenience of a headset.

U.S. Pat. Nos. 5,272,757, 5,459,790, 5,661,812, and 5,841,879, all to Scofield disclose head mounted surround sound systems. However, none of the Scofield systems appear to use head related transfer function (HRTF) filtering to produce spatialized audio signals. Furthermore, Scofield uses a system that converts signals from a multiple surround speaker system to a pair of signals for two speakers. This system appears to fail a real-time spatialization system where a person's head position varies in orientation and azimuth, thus requiring adjustment in filtering in order to maintain appropriate spatial locations.

One current method for generating spatialized audio is to use multiple speaker panning. This method only works for listeners positioned at a sweet spot within the speaker array. This method cannot be used for mobile applications. Another method, often used with headphones, requires complex individual filters or synthesized sound reflections. This method performs filtering of a monaural source with a pair of filters defined by a pair of head related transfer functions (HRTFs) for a particular location. Each of these methods have limitations and disadvantages. The latter method works best if individual filters are used, but the procedure to produce individual filters is complex. Further, if individual filters or synthesized sound reflections are not used, then front-back confusions and poor externalization of the sound source would result. Thus, there is a need to overcome the above-identified problems.

Accordingly, the present invention provides a solution to overcome the above problems. In the present invention, a pair of speakers is mounted in a location near the temple of a listener's head, such for example, on an eyeglass frame or inside a helmet, rather than in headphones. A head tracking system also mounted on the frame where speakers are mounted determines the location and orientation of the listener's head and provides the measurements to a computer system for audio signal processing in conjunction with a head related transfer function (HRTF) filter to produce spatialized audio. The HRTF filter maintains virtual location of the audio signals, thus allowing the listener to change locations and head orientation without degradation of the audio signal. The system of the present invention produces virtual sound sources that are externally perceived and positioned at any desired orientation in azimuth and elevation from the listener.

In its broader aspects, the present invention provides an apparatus for producing spatialized audio, the apparatus comprising at least one pair of speakers positioned near a user's temple for generating spatialized audio signals, whereby the speakers are positioned coaxially with a user's ear regardless of the user's head movement; a tracking system for tracking the user's head orientation and location; a head related transfer function (HRTF) filter for maintaining virtual location of the audio signals thereby allowing the user to change location and head orientation without degradation of the virtual location of audio signals; and a processor for receiving signals from the tracking system and causing the filter to generate spatialized audio, wherein the speakers are positioned to generate frontal positioning cues to augment spatial filtering for virtual frontal sources without degrading spatial filtering for other virtual positions.

In another aspect, a method of producing spatialized audio signals, the method comprising: positioning at least one pair of speakers near a user's temple for generating spatialized audio signals, whereby the speakers are positioned coaxially with a user's ear regardless of the user's head movement to generate frontal positioning cues to augment spatial filtering for virtual frontal sources without degrading spatial filtering for other virtual positions; tracking orientation and location of the user's head using a tracking system; maintaining virtual location of the audio signals using a head related transfer function (HRTF) filter; and processing signals received from the tracking system using a processor; and controlling the filter using the processor to generate spatialized audio signals.

In a further aspect, the present invention provides a system for producing spatialized audio signals, the system comprising: means for positioning at least one pair of speakers near a user's temple for generating spatialized audio signals, whereby the speakers are positioned coaxially with a user's ear regardless of the user's head movement; a tracking means for tracking orientation and location of the user's head; a filtering means for maintaining virtual location of the audio signals; and means for processing signals received from the tracking means; and means for controlling the filter means to generate spatialized audio signals.

BRIEF DESCRIPTION OF THE DRAWINGS

FIGS. 3–4 illustrate various methods of mounting the speakers as shown in FIGS. 1–2.

DETAILED DESCRIPTION OF THE INVENTION

Figure 1:
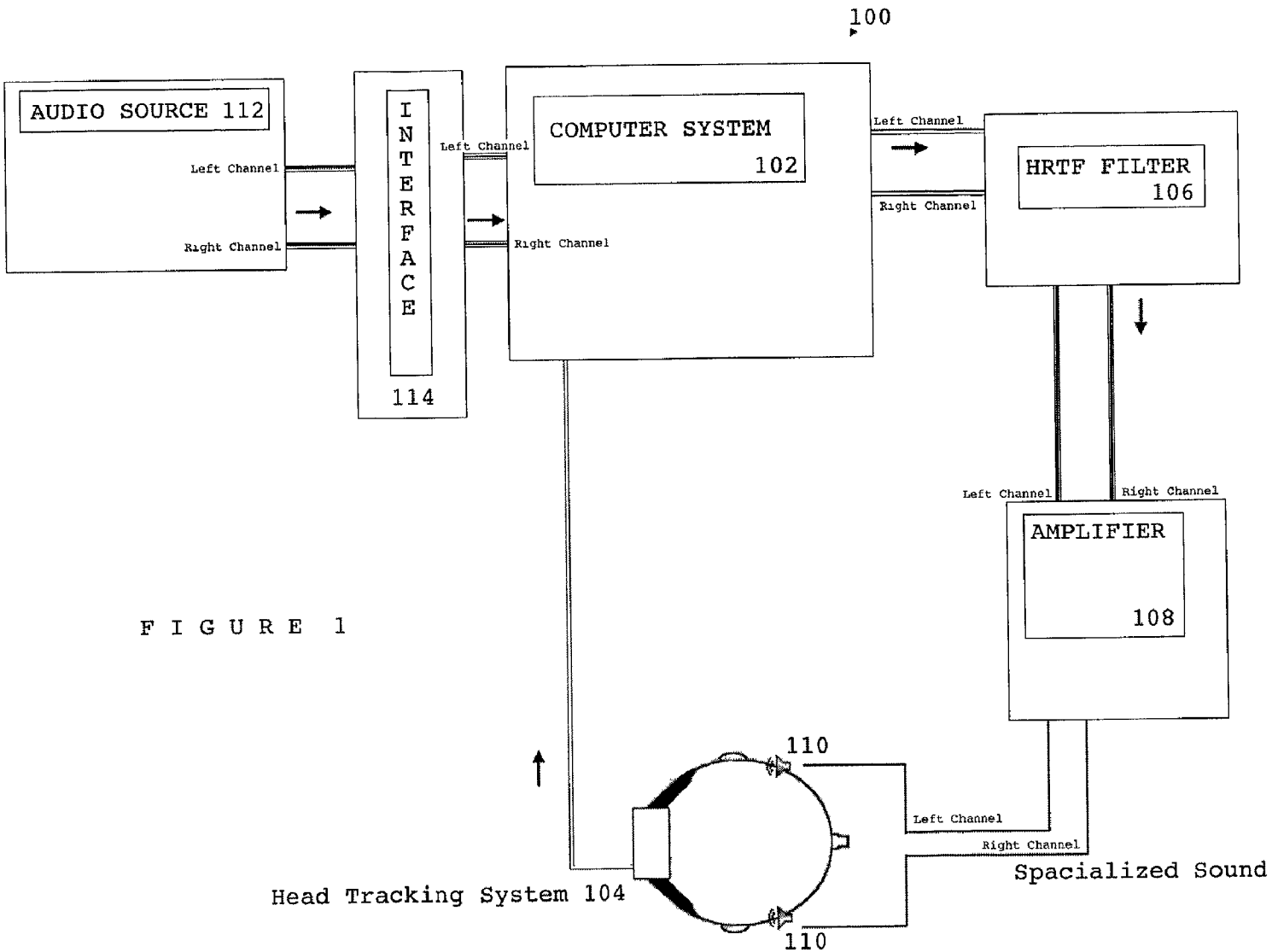
FIG. 1 illustrates an exemplary system configuration of the present invention.

FIG. 1 shows an exemplary audio system configuration of the present invention as generally indicated at 100. The audio system 100 includes a computer system 102 for controlling various components of system 100. Audio signals from an audio source, such as for example, an audio server 112 are received by the computer system 102 for further processing. The computer system 102 is an "off the shelf" commercially available system and could be selected from any of the following systems, which have been used to implement this invention: the Crystal River Engineering Acoustetron II; the Hewlett Packard Omnibook with a Crystal PnP audio system and RSC 3d audio software; an Apple Cube with USB stereo output and 3D audio software.

A head tracking system 104 is mounted on a frame to which speakers 110 are attached close to the temple of a user's head. The frame is mounted on the user's head and moves as the head moves. Any conventional means for attaching the speakers to the frame may be used, such as for example, using fasteners, adhesive tape, adhesives, or the like. The head tracking system 104 measures the location and orientation of a user's head and provides the measured information to the computer system 102 which processes the audio signals using a head related transfer function (HRTF) filter 106 thus producing spatialized audio. The spatialized audio signals are amplified in an amplifier 108 and fed to speakers 110. The amplified signals are binaural in nature (i.e., left channel signals are supplied to the left ear and right channel signals are supplied to the right ear. The amplifier 108 generates sound that is loud enough to be heard in the nearest ear but generally too soft to be heard in the opposite ear. The speakers 110 are mounted, for example, to an eyeglass frame or appropriately mounted to the inside of a helmet as shown in FIGS. 3 and 4. The speakers may also be mounted on a virtual reality head mounted visual display system. A miniature amphitheater-shell may be added to the mounting frame in order to increase the efficiency of the speakers.

In operation, location and orientation information measured by the head tracking system 104 is forwarded to the computer system 102 which then processes the audio signals, received from an audio server, using a head related transfer function filter 106 to produce a spatialized audio signals. The spatialized audio signals are amplified in an amplifier 108 and then fed to the speakers 110. The source of the sound is kept on axis with user's ear regardless of the head movement, thus simplifying the spatialization computation.

Figure 2:
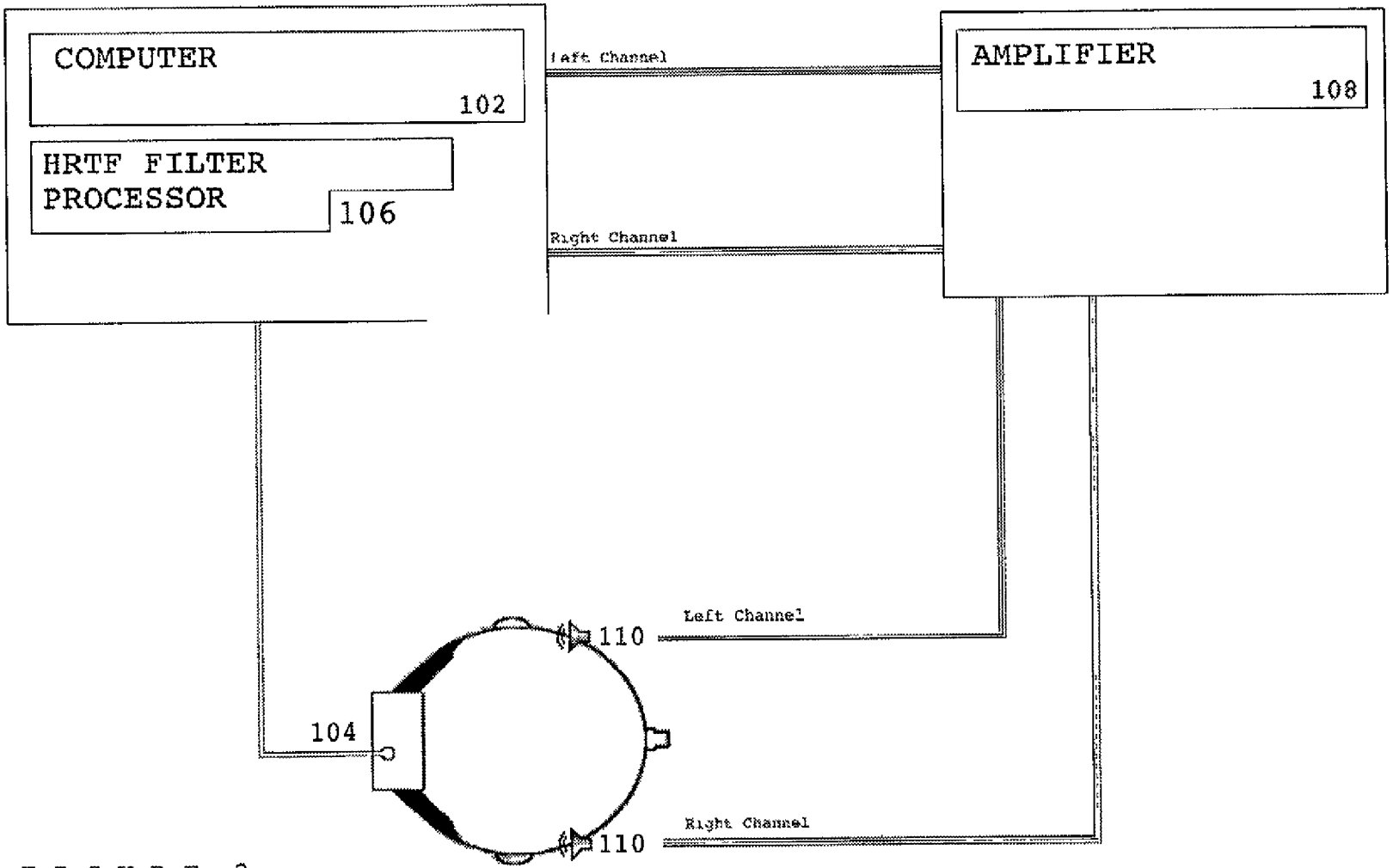
FIG. 2 illustrates another embodiment of the present invention as shown in FIG. 1.

FIG. 2 shows another embodiment of the present invention as in FIG. 1. Here, the processor 102 also performs the HRTF filtering functions. The audio source is generated and operates under the control of the computer system. The rest of the operation of FIG. 2 is similar to the operation as explained with respect to FIG. 1.

While specific positions for various components comprising the invention are given above, it should be understood that those are only indicative of the relative positions most likely needed to achieve a desired sound effect with reduced noise margins. It will be appreciated that the indicated components are exemplary, and several other components may be added or subtracted while not deviating from the spirit and scope of the invention.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. An apparatus comprising:

a signal portion operable to provide audio signals corresponding to a sound to be reproduced and a virtual location of a source of the sound to be reproduced;

a wearing portion to be worn by a person;

a tracking system operable to provide tracking signals corresponding to an orientation and location of the head of the person;

a head related transfer function (HRTF) filter; and speakers mounted on said wearing portion, wherein said HRTF filter is operable to spatially filter the audio signals, based on the tracking signals, and thereby provide spatially filtered audio signals, wherein said speakers are operable to reproduce the sound based on the spatially filtered audio signals such that the person hears the sound and perceives a maintained virtual location of the source of the sound, and wherein said speakers are mounted on said wearing portion at a position which augments the sound reproduced by said speakers such that perceived front-to-back reversals in the maintained virtual location of the source of the sound are reduced.

2. The apparatus of claim 1, wherein the perceived front-to-back reversals comprise a perceived virtual location of a source of a sound incorrectly reversing from in front of the listener to in back of the listener.

3. The apparatus of claim 1, wherein said signal portion is operable to provide the audio signals as binaural audio signals.

4. The apparatus of claim 1, wherein said wearing portion comprises an eyeglass frame.

5. The apparatus of claim 1, wherein said wearing portion is constructed to be mounted in a helmet.

6. The apparatus of claim 1, further comprising an amplifier operable to amplify the spatially filtered audio signals such that a portion of the sound reproduced by each speaker of said speakers is sufficiently loud to be heard by only one ear of the person.

7. A method of producing spatialized audio signals, said method comprising:

providing audio signals corresponding to a sound to be reproduced and a virtual location of a source of the sound to be reproduced;

providing tracking signals corresponding to the orientation and location of the head of a person;

spatially filtering the audio signals, based on the tracking signals, to provide spatially filtered audio signals; and reproducing, via speakers, the sound based on the spatially filtered audio signals such that the person hears the sound and perceives a maintained virtual location of the source of the sound, wherein said reproducing comprises reproducing via speakers that are disposed at a position which augments the sound reproduced by the speakers such that perceived front-to-back reversals in the maintained virtual location of the source of the sound are reduced.

8. The method of claim 7, wherein said providing audio signals comprises providing binaural audio signals.

9. An apparatus comprising:

a signal means for providing audio signals corresponding to a sound to be reproduced and a virtual location of a source of the sound to be reproduced;

a wearing portion to be worn by a person;

a tracking means for providing tracking signals corresponding to an orientation and location of the head of the person;

a head related transfer function (HRTF) filter; and speakers mounted on said wearing portion, wherein said HRTF filter is operable to spatially filter the audio signals, based on the tracking signals, and thereby provide spatially filtered audio signals, wherein said speakers are operable to reproduce the sound based on the spatially filtered audio signals such that the person hears the sound and perceives a maintained virtual location of the source of the sound, and wherein said speakers are mounted on said wearing portion at a position which augments the sound reproduced by said speakers such that perceived front-to-back reversals in the maintained virtual location of the source of the sound are reduced.

* * * * *